US005933895A

United States Patent [19]

Moon

[11] Patent Number: 5,933,895

[45] Date of Patent: Aug. 10, 1999

[54] APPARATUS FOR CONTROLLING INPUT OF TEXTILE SOFTENER IN WASHING MACHINE AND METHOD THEREOF

[75] Inventor: Gyeong Ho Moon, Kyungsangnam-do, Rep. of Korea

[73] Assignee: LG Electronics Inc., Seoul, Rep. of Korea

[21] Appl. No.: 08/549,279

[22] Filed: Oct. 27, 1995

[30] Foreign Application Priority Data

May 22, 1995 [KR] Rep. of Korea ..... 95-12776

[51] Int. Cl.[6] ..... D06F 39/02

[52] U.S. Cl. ..... 8/159; 68/17 R; 68/12.27; 68/12.02

[58] Field of Search ..... 68/17 R, 12.02, 68/12.12, 12.23, 207, 12.27; 8/158, 159

[56] References Cited

U.S. PATENT DOCUMENTS

| | | | |
|---|---|---|---|
| 4,245,309 | 1/1981 | Kieer | 68/12.23 |
| 4,455,701 | 6/1984 | Stehr et al. | 68/12.23 |
| 4,955,213 | 9/1990 | Ohsugi et al. | 68/12.12 |
| 4,981,024 | 1/1991 | Beldham | 68/17 R |
| 5,074,003 | 12/1991 | Manson et al. | 8/159 |
| 5,280,423 | 1/1994 | Imai et al. | 68/12.23 |

FOREIGN PATENT DOCUMENTS

| | | | |
|---|---|---|---|
| 2557977 | 7/1976 | Germany | 68/12.23 |
| 2744694 | 4/1978 | Germany | 68/12.23 |
| 2810948 | 9/1978 | Germany | 68/12.23 |
| 3242411 | 5/1984 | Germany | 68/17 R |
| 35-148162 | 12/1978 | Japan | 68/12.23 |
| 60-235295 | 11/1985 | Japan | 68/12.23 |
| 1-209099 | 8/1989 | Japan | 68/12.02 |
| 2134078 | 8/1984 | United Kingdom | 68/17 R |

*Primary Examiner*—Frankie L. Stinson

*Attorney, Agent, or Firm*—John P. White; Cooper & Dunham LLP

[57] ABSTRACT

An apparatus for controlling input of textile softener in a washing machine, wherein a textile softener input function is provided by arranging the textile softener input function in a washing course selection displayer disposed on an operation panel to be performed as an independent course or to be associated with other washing courses. A method for controlling input of textile softener in a washing machine comprising the steps of: halting operation of the washing machine after water-supply is completed in the last rinsing stroke; sounding a buzzer n-times after halting the operation of the washing machine; waiting for a predetermined time after completion of the buzzer sound; and performing a rinsing and dehydration strokes only when the textile softener is put in a washtub and the washing machine is re-operated, or waiting continuously when the washing machine is not re-operated. Therefore, the input of the textile softener is facilitated and effect of inputting the textile softener to the laundry and rinsing function increases.

1 Claim, 9 Drawing Sheets

F.I G.2
prior art

1-RINSING:SAME AS SELECTING 1-RINSING OF FIG.2
2-RINSING:SAME AS 2-RINSING OF FIG.2
3-RINSING:

F. I G.5
prior art

APPARATUS FOR CONTROLLING INPUT OF TEXTILE SOFTENER IN WASHING MACHINE AND METHOD THEREOF

BACKGROUND OF THE INVENTION

The present invention relates to an apparatus for controlling input of a textile softener in a washing machine and a method thereof, and more particularly, to an apparatus and a method thereof, which provides convenience for a washing machine user and improving effect of inputting a textile softener in the laundry by informing the user of input time of the textile softener during the last rinsing course.

FIG. 1 is a block diagram illustrating a rinsing indicator in a conventional washing machine and a process operated by pushing a key for rinsing when the number of rinsing is selected by a user. The frequency of rinsing can be selected between one to four times. A basic process of the rinsing comprises steps of "drainage" for draining water, "intermittent dehydration" for gradually increasing revolution of a washtub by repeatedly turning on and off a washing motor, "dehydration" for dehydrating water from the laundry, "pause" for pausing for full stop of inertial revolving force of the washing drum after predetermined dehydration duration, "water-supply" for supplying water, and "rinsing" for rinsing soupy water and contaminant by shaking the laundry. Selection between one to four times are available after water-supply and rinsing steps are selected.

FIG. 2 is a block diagram showing a process according to rinsing frequency in the conventional washing machine. When "1-rinsing" is selected, a sequence of drain, intermittent dehydration, dehydration, pause, dehydration, pause, water-supply, and rinsing is performed one time. When "2-rinsing" is selected, a "rinsing stroke" consisting steps of drain, intermittent dehydration, dehydration, pause, water-supply, rinsing is repeated twice. When "3- or 4-rinsing" is selected, the rinsing stroke is repeated as many as the number.

FIG. 3 is a block diagram showing a process according to the frequency of rinsing strokes for facilitating an input of textile softener in the conventional washing machine. When rinsing of 1 or 2 times are selected, the process is the same as that shown in FIG. 2. However, when 3- or 4-rinsing are selected, steps of the intermittent dehydration, dehydration and pause are omitted in the rinsing stroke of the 2-rinsing process.

FIG. 4 is a block diagram showing an operation panel when a washing course changes in the conventional washing machine. Courses consisting of "fuzzy," "custom," "enzyme," "blanket" and "wool" are displayed on a washing course selection display unit 2*a* installed in an operation panel 1*a*. When a power switch is pushed on, a "fuzzy" course is lighted and selected. Under this state, a user can select a necessary washing course since a course consisting of custom, enzyme, soaking, blanket, wool and fuzzy successively proceeds by pushing a course key 3.

In the meantime, as shown in FIGS. 5 and 6, a detachable softener case 5 for inputting textile softener by a user is arranged at the upper portion inside of a washtub 4. When a washing machine is operated after softener case 5 containing textile softener is installed in washtub 4, textile softener contained in softener case 5 is overflowed and contained a first compartment 6 when an acceleration force of revolution is generated in washtub 4 during the steps of intermittent dehydration and dehydration in "rinsing stroke." After the rinsing stroke, textile softener in first compartment 6 is overflowed and contained a second compartment 7 when an acceleration force of revolution is generated in washtub 4 during the steps of intermittent dehydration and dehydration in the next stroke. That is, when the 2-rinsing is selected in FIG. 2, the textile softener contained in softener case 5 is passed into first compartment 6 when a revolution force of washtub 4 increases during the steps of intermittent dehydration and dehydration in the first "rinsing stroke." Then, in a pause step, the revolution of washing drum 4 stops; water is supplied; and the next rinsing step proceeds. In the second rinsing stroke, the textile softener in first compartment 6 passed to second compartment 7 during the increase of revolution force in the steps of intermittent dehydration and dehydration of the second rinsing stroke. Then, the revolution of washing drum 4 stops, water is supplied and rinsing proceeds during the pause period after the dehydration step finishes.

Here, the textile softener in second compartment 7 is drained to washtub 4 through an opening 8 at the lower side of softener case 5, and well-mixed with the laundry during the rinsing step.

Also, when the 1-rinsing is selected, a pause step is arranged after the steps of intermittent dehydration and dehydration to stop washtub 4 and again dehydrate so as to perform acceleration twice, so that the textile softener in softener case 5 is passed into second compartment 7 and the textile softener is well-mixed with the laundry by performing water-supply and rinsing steps.

On the contrary, when the 3-rinsing is selected, the textile softener well-mixed with the laundry in the second rinsing escapes during the intermittent dehydration and dehydration steps of "rinsing stroke" in the third rinsing, so that the textile softener becomes much ineffective. When the 4-rinsing is selected, no effect of the textile softener remains since the above step repeats twice.

To compensate for the above-described demerits of FIG. 2, when the 3- or 4-rinsing is selected as in FIG. 3, the steps of intermittent dehydration, dehydration and pause are omitted during the second or second and third times of the rinsing. Though the textile effect improves, however, a fundamental function "rinsing" becomes inferior.

As described above, in the conventional washing machine, the poor textile effect is obtained in case of selecting the 3- or 4-rinsing course, and use of softener case 5 is inconvenient. Particularly, the softener case installed at inside of washtub 4 cannot be found easily, and using softener case 5 by putting textile softener therein does not well-known to users. Further, the controlling system as shown in FIG. 3 which compensates for the input of the textile softener shows better input effect of the textile softener, and however, rinsing function is much inferior, leading to lowering of products reliability.

SUMMARY OF THE INVENTION

To solve the above problems, it is an object of the present invention to provide an apparatus for controlling an input of textile softener in a washing machine and a method thereof, by which input control of the textile softener can be achieved in selecting rinsing frequency in the washing machine and input time of the textile softener can be noticed to a user in the last rinsing step, thereby facilitating the input of the textile softener and increasing effect of inputting the textile softener to the laundry and rinsing function.

Accordingly, to achieve the above object, there is provided an apparatus for controlling input of textile softener in a washing machine, wherein a textile softener input function is provided by arranging the textile softener input function in a washing course selection displayer disposed on an operation panel to be performed as an independent course or to be associated with other washing courses.

To achieve the above object, there is provided a method for controlling input of textile softener in a washing machine comprising the steps of: halting operation of the washing machine after water-supply is completed in the last rinsing stroke; sounding a buzzer n-times after halting the operation of the washing machine; waiting for a predetermined time after completion of the buzzer sound; and performing a rinsing and dehydration strokes only when the textile softener is put in a washtub and the washing machine is re-operated, or waiting continuously when the washing machine is not re-operated.

BRIEF DESCRIPTION OF THE DRAWINGS

The above objects and advantages of the present invention will become more apparent by describing in detail a preferred embodiment thereof with reference to the attached drawings in which.

DETAILED DESCRIPTION OF THE INVENTION

In the present invention, a "textile softener input function" installed in a washing course selection displayer 2 disposed on an operation panel 1 is made to be selected as an independent course or associated with other washing courses.

Figure 1:
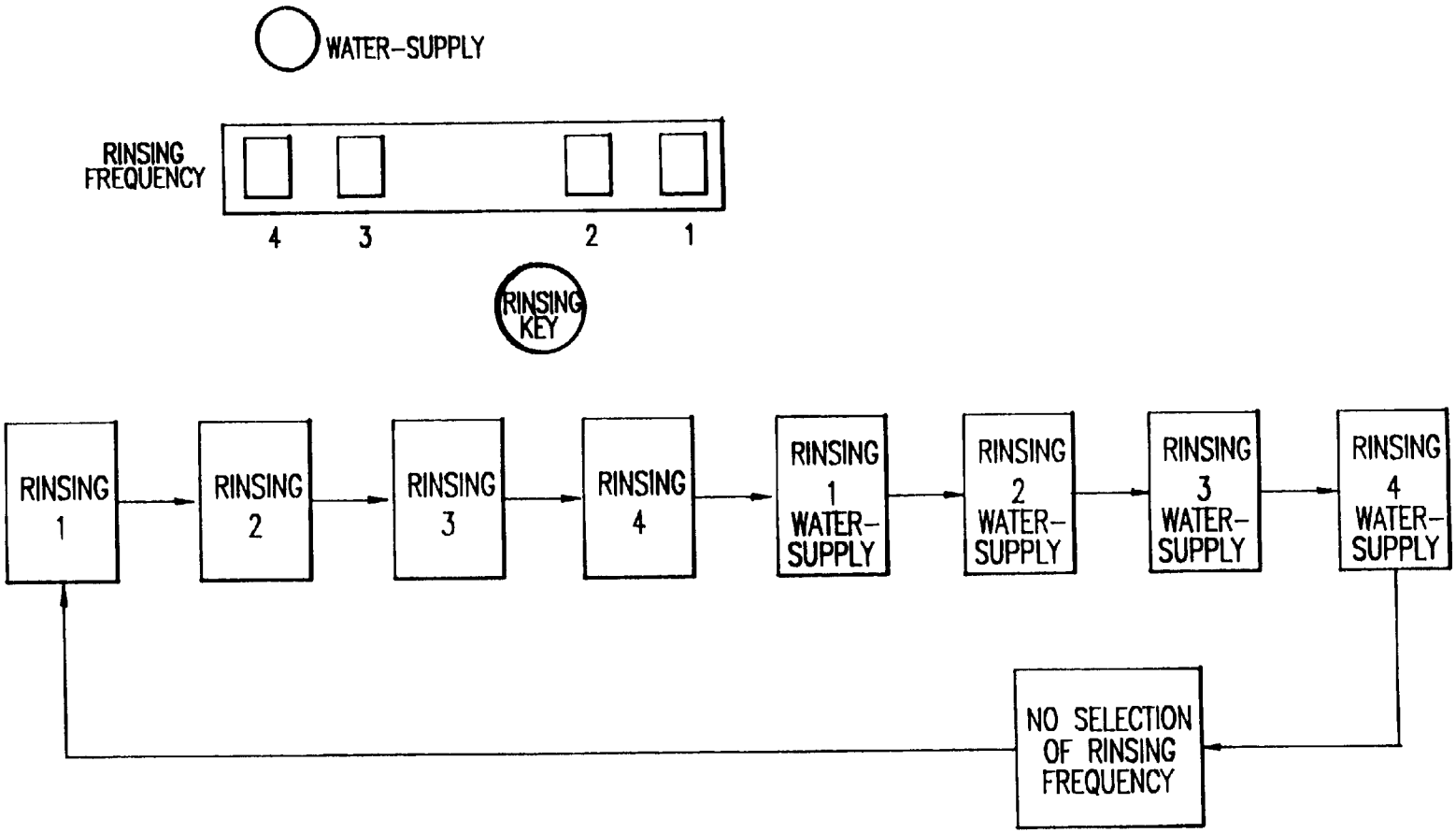
FIG.1 prior art
FIG. 1 is a block diagram illustrating a rinsing indicator in a conventional washing machine and a process operated by pushing a key for rinsing when the number of rinsing is selected by a user.
Figure 2:
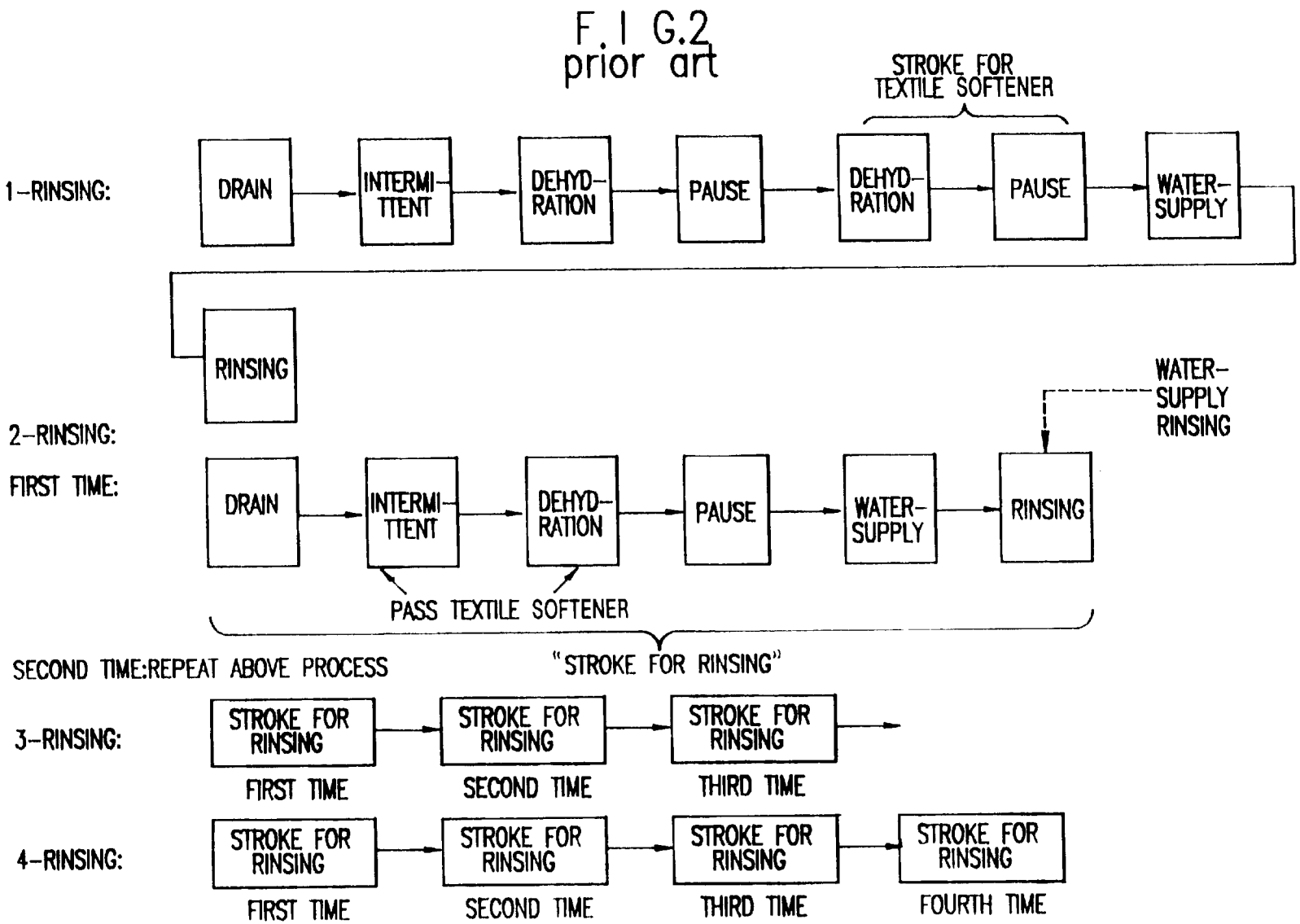
FIG. 2 is a block diagram showing a process according to rinsing frequency in the conventional washing machine.
Figure 3:
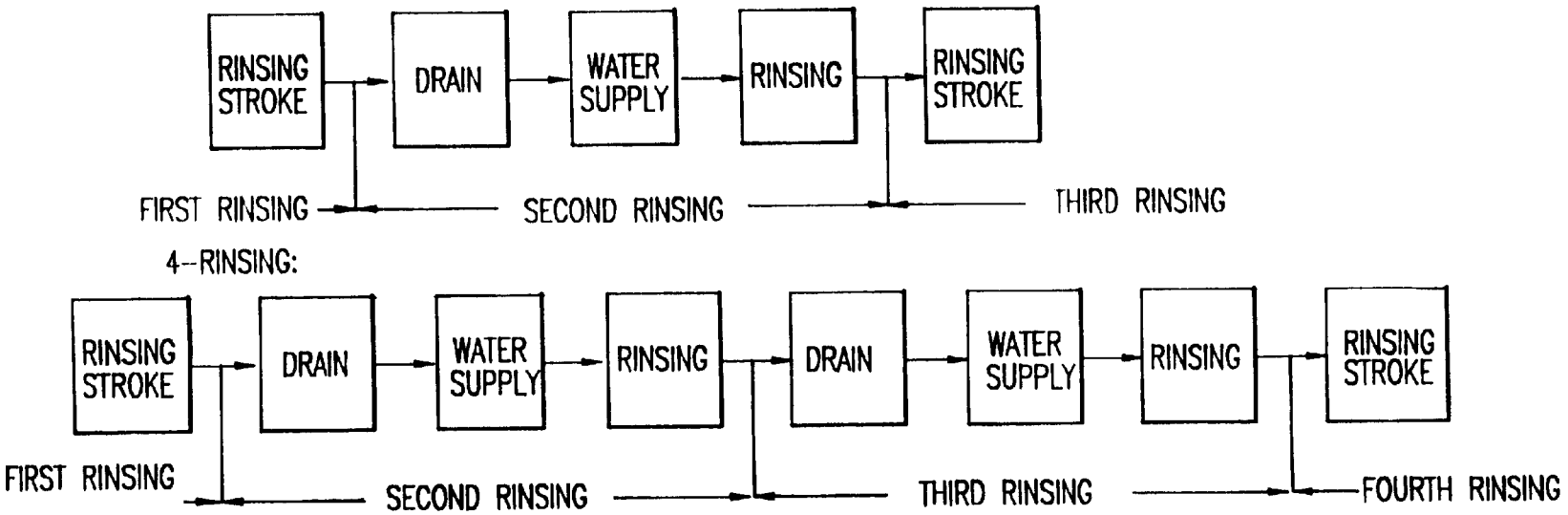
FIG. 3 prior art
FIG. 3 is a block diagram showing a process according to the frequency of rinsing strokes for facilitating an input of textile softener in the conventional washing machine.
Figure 4:
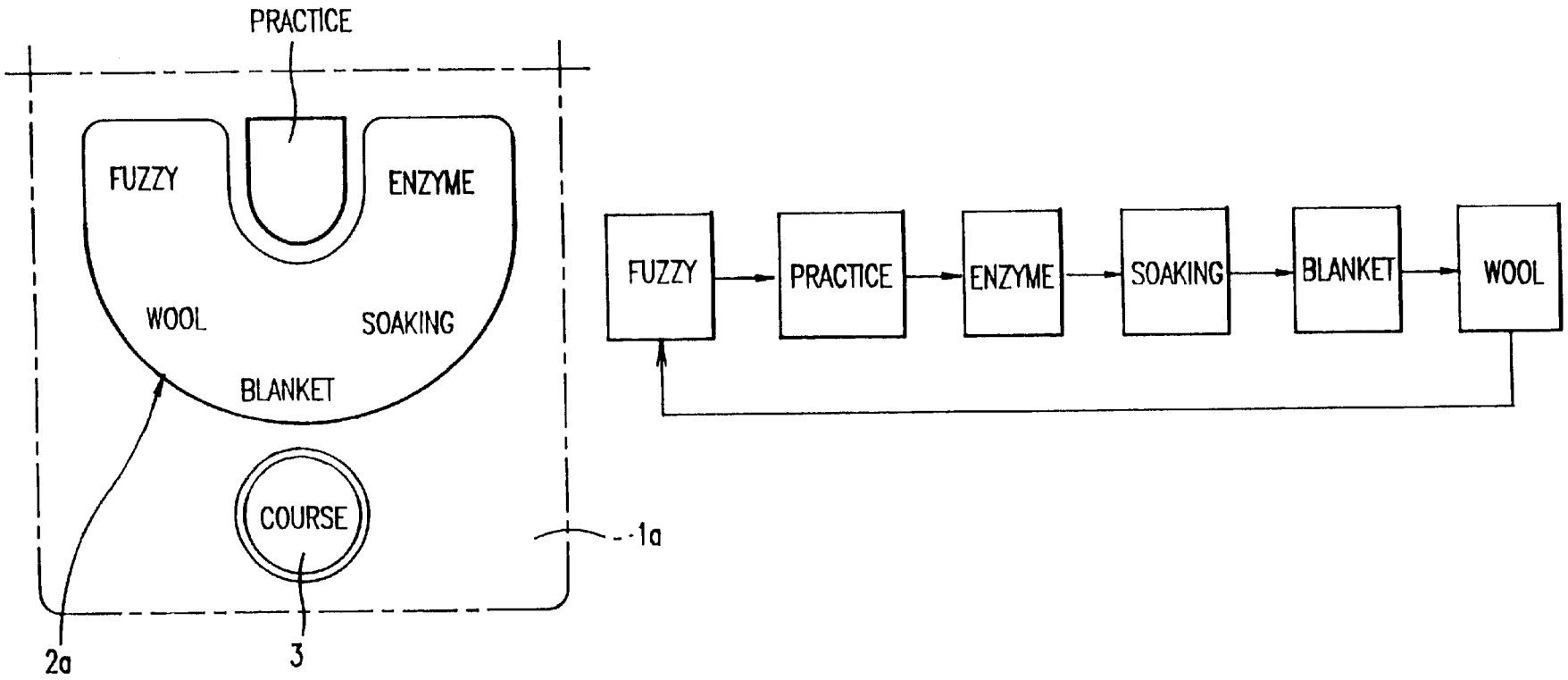
FIG. 4 is a block diagram showing an operation panel when a washing course changes in the conventional washing machine.
Figure 5:
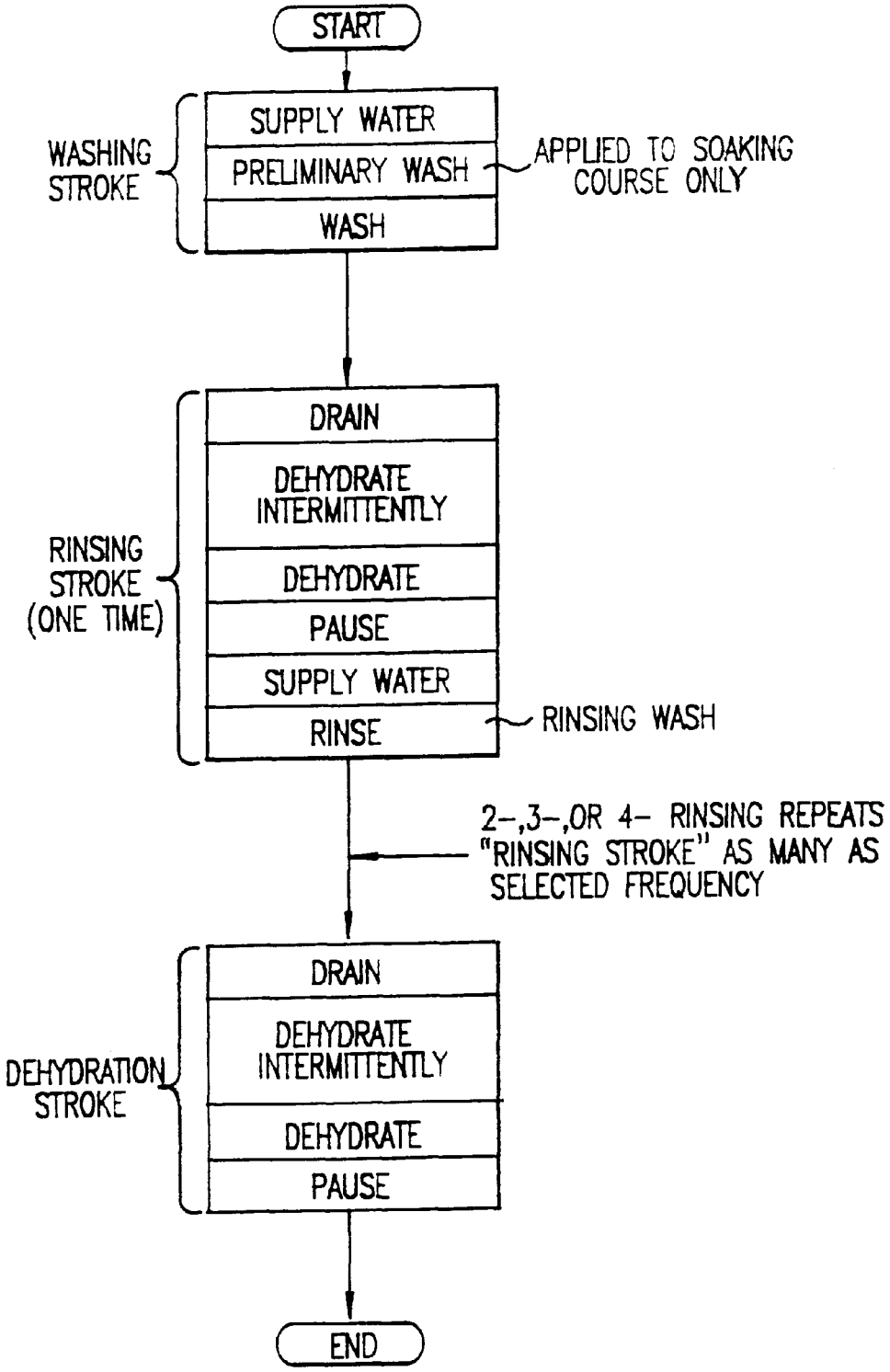
FIG. 5 is a flowchart for explaining an operation process of the conventional washing machine.
Figure 6:
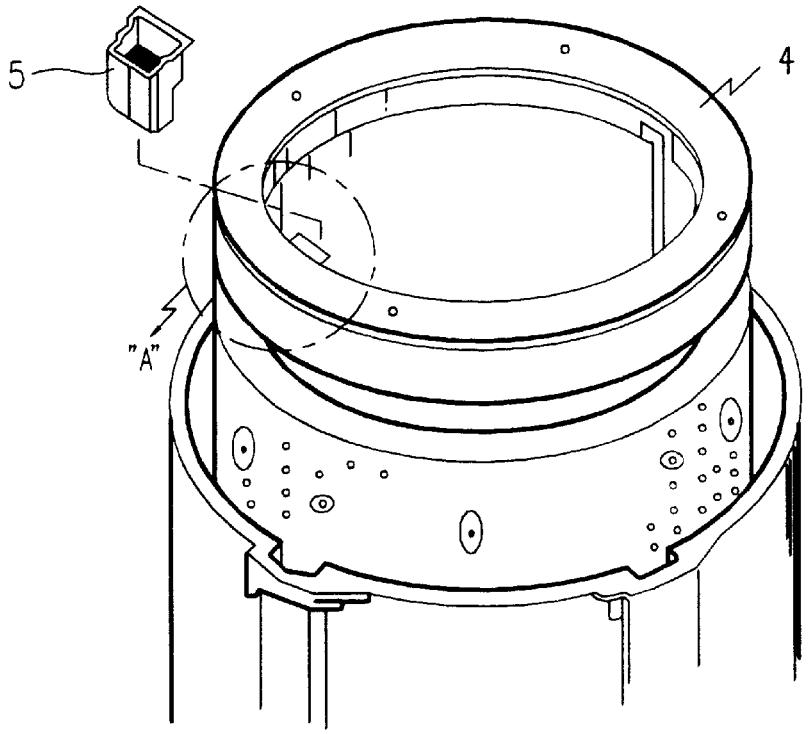
F I G.6 prior art
FIG. 6 is a perspective view illustrating a status that a softener case for containing textile softener is being assembled in the conventional washing machine.
Figure 7:
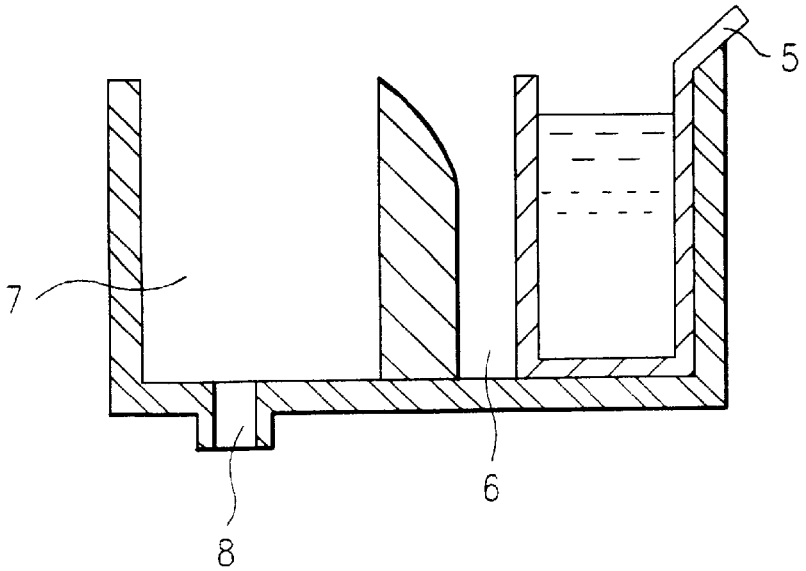
F I G.7 prior art
FIG. 7 is a vertical cross sectional view of part A of FIG. 6.
Figure 8:
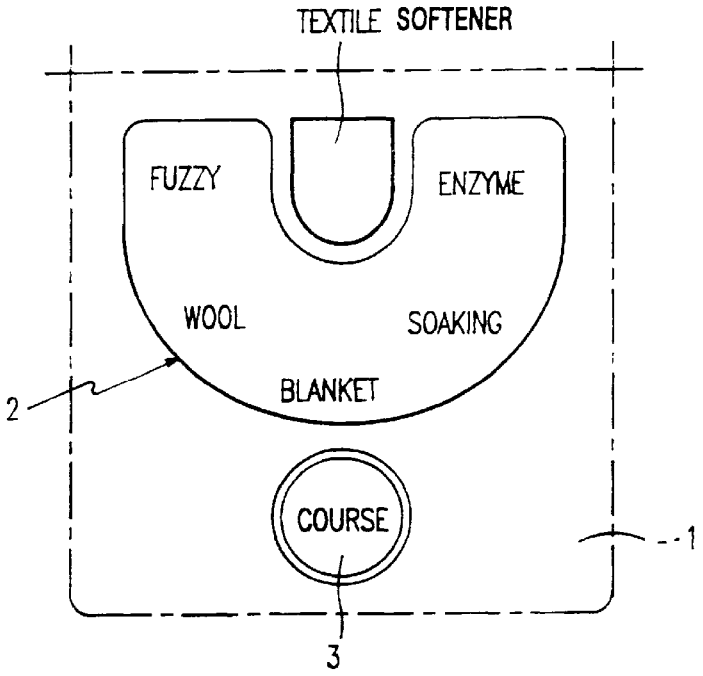
FIG. 8 is a front view showing a washing course selection displayer of an operation panel according to the present invention.
Figure 9A:
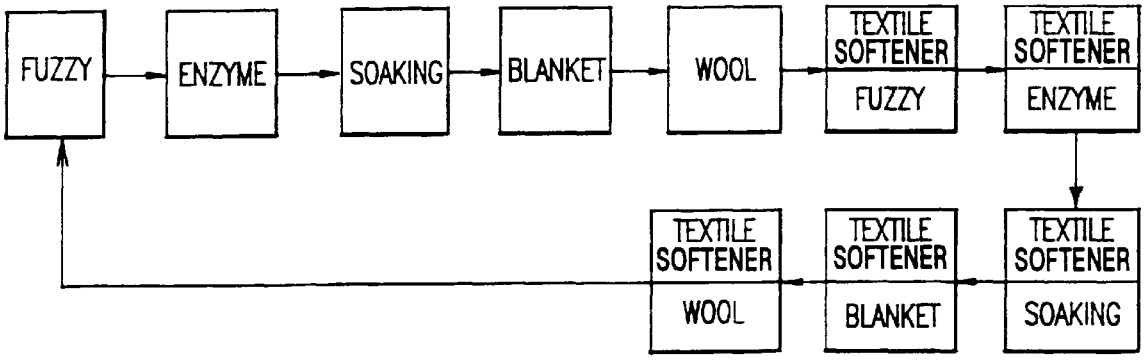
FIGS. 9A and 9B is a block diagram showing a selection of a washing course according to the present invention.
Figure 9B:
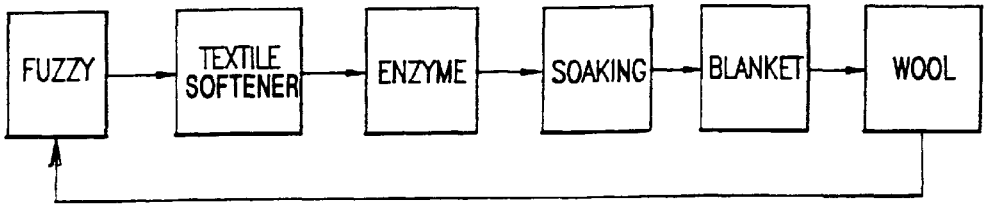

As shown in FIG. 8, washing course selection displayer 2 on operation panel 1 comprises "fuzzy," "textile softener," "enzyme," "soaking," "blanket" and "wool." A user can select by pressing a course key 3 to select a desired course which is constructed as five courses without a textile softener function and five courses with the textile softener function as in FIG. 9A, or six courses by selecting the textile softener as an independent course as in FIG. 9B.

Namely, in FIG. 9A, a light emitting device for "textile softener" turns off when the washing course without the textile softener, and when the textile softener is selected, two light emitting devices for the relevant course and "textile softener" are turned on concurrently. In case of FIG. 9B, since courses are independently constructed, light is tuned on only for each of a selected course. Here, the textile softener course has the same stroke procession as the "fuzzy" course, and however, a controlling method for inputting the textile softener during the last rinsing step is differently applied.

Figure 10:
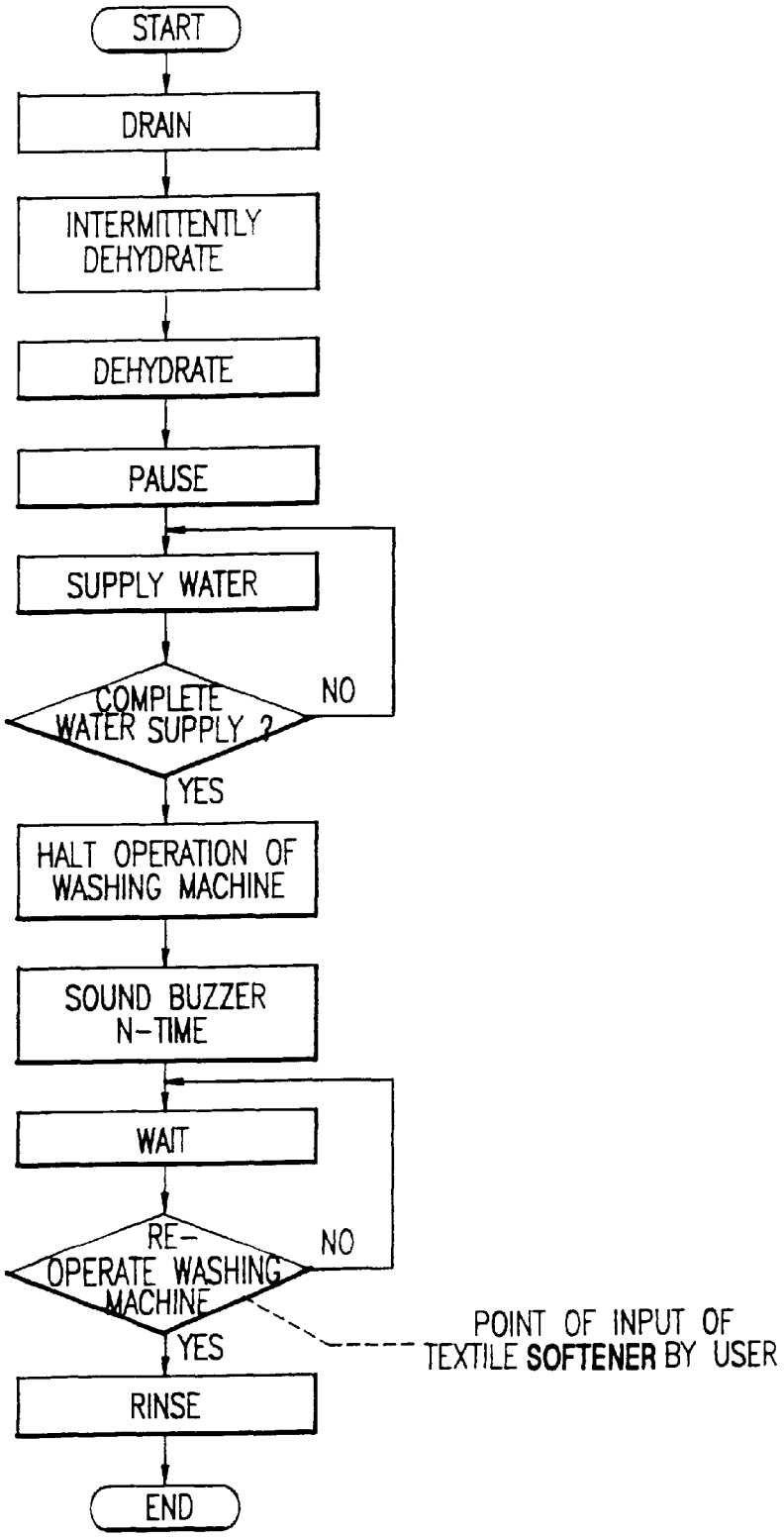
FIG. 10 is a flowchart for explaining a process of inputting textile softener in the last rinsing stroke according to the present invention.
Figure 11:
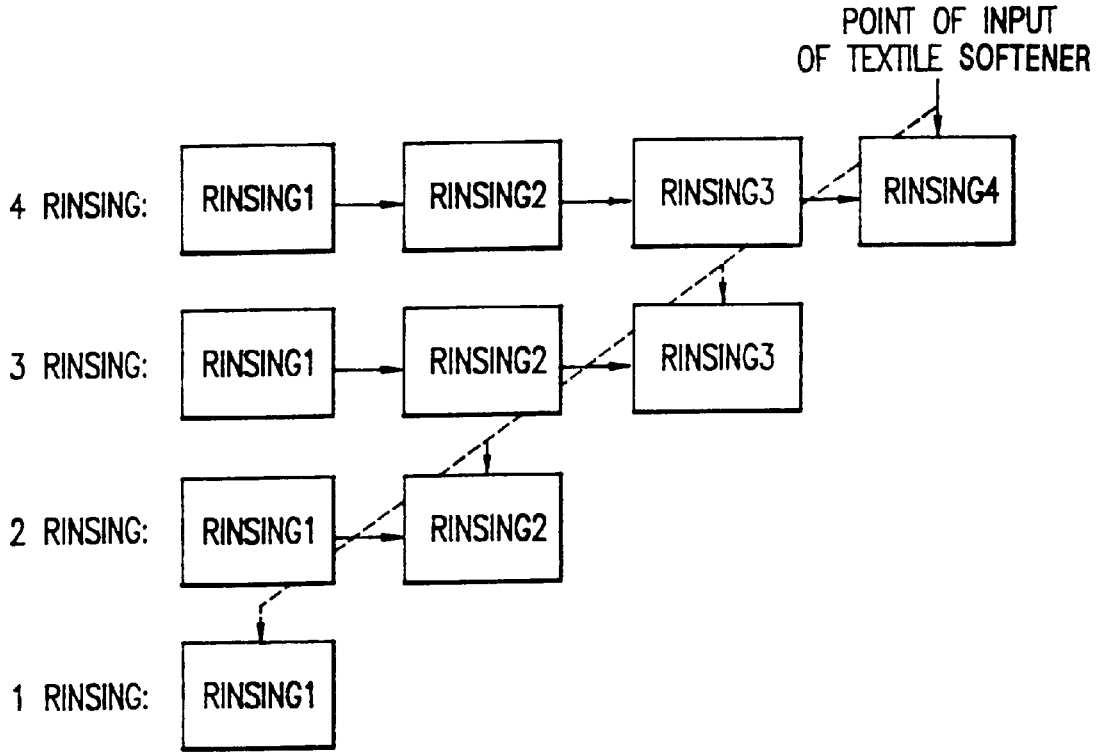
FIG. 11 is a block diagram showing a rinsing stroke according to the present invention.

When the textile softener is selected in the above process, a washing machine operates as in FIGS. 10 and 11.

Regardless of selection of rinsing frequency in the washing machine, operation of the washing machine is stopped after steps of drain, intermittent dehydration, dehydration, pause, and water-supply are completed in the last rinsing stroke. Then, a buzzer sounds n-times for alerting a user to input the textile softener. When the washing machine is re-operated by the user after the textile softener input is completed, the washing machine performs the remaining "rinsing" step. The rinsing stroke except for the last one is performed as the conventional rinsing stroke.

On the other hand, when a user does not re-operates the washing machine after the buzzer is sounded n-times, the washing machine keeps to wait continuously till the user inputs the textile softener and re-operates the washing machine. However, the textile softener can be put not only in a softener case but also directly in a washtub.

As described above, in the apparatus for controlling the input of the textile softener and the method thereof according to the present invention, the input control of the textile softener can be achieved when rinsing frequency is selected in the washing machine and input time of the textile softener can be noticed to a user in the last rinsing step, thereby facilitating the input of the textile softener and increasing effect of inputting the textile softener to the laundry and rinsing function.

What is claimed is:

1. A method for controlling input of textile softener in a washing machine comprising the steps of:

halting operation of the washing machine after water-supply is completed in the last rinsing stroke;

sounding a buzzer n-times after halting the operation of the washing machine;

waiting for a predetermined time after completion of the buzzer sound; and performing a rinsing and dehydration strokes only when the textile softener is put in a washtub and the washing machine is re-operated, or waiting continuously when the washing machine is not re-operated.

* * * * *